US008424693B1

(12) United States Patent
Hoover

(10) Patent No.: US 8,424,693 B1
(45) Date of Patent: Apr. 23, 2013

(54) ROLLOUT DROP DOWN SHELVES

(76) Inventor: James A. Hoover, Elizabeth, PA (US)

( * ) Notice: Subject to any disclaimer, the term of this patent is extended or adjusted under 35 U.S.C. 154(b) by 157 days.

(21) Appl. No.: 13/066,271

(22) Filed: Apr. 11, 2011

(51) Int. Cl.

| | |
|---|---|
| ***A47F 7/145*** | (2006.01) |
| ***A47F 7/143*** | (2006.01) |
| ***A47F 7/146*** | (2006.01) |
| ***A47B 2031/003*** | (2006.01) |
| ***A47B 2088/0448*** | (2006.01) |
| ***A47B 2210/0224*** | (2006.01) |

(52) U.S. Cl.
USPC ..... 211/55; 211/126.15

(58) Field of Classification Search ..... 211/55, 211/52, 126.15, 88.01, 94.02, 175, 85.29, 211/128.1; 108/99, 100; 312/325, 246, 248, 312/330.1, 319.3
See application file for complete search history.

(56) References Cited

U.S. PATENT DOCUMENTS

| | | | | |
|---|---|---|---|---|
| 264,748 | A | 9/1882 | Potts | |
| 841,813 | A * | 1/1907 | Plummer | 190/17 |
| 884,428 | A * | 4/1908 | Strong | 312/201 |
| 886,066 | A | 4/1908 | Obertrifter | |
| 1,019,850 | A | 3/1912 | Shutes | |
| 1,568,212 | A | 1/1926 | Cygan | |
| 1,985,593 | A | 12/1934 | Allen | |
| 3,612,635 | A * | 10/1971 | Uyeda et al. | 312/272 |
| 3,995,926 | A * | 12/1976 | Kessler, Sr. | 312/325 |
| 4,874,211 | A | 10/1989 | Nichols | |
| 5,244,272 | A | 9/1993 | Thompson | |
| 5,308,158 | A * | 5/1994 | Vogelgesang et al. | 312/319.3 |
| 5,871,107 | A | 2/1999 | Johnson et al. | |
| 5,957,558 | A | 9/1999 | Quade | |
| 6,832,689 | B2 * | 12/2004 | Cho | 206/743 |
| 7,168,773 | B1 * | 1/2007 | Emary | 312/246 |
| 7,731,805 | B2 * | 6/2010 | Banta et al. | 134/56 D |
| 7,770,986 | B1 * | 8/2010 | Simaitis | 312/247 |

* cited by examiner

*Primary Examiner* — Jennifer E Novosad
(74) *Attorney, Agent, or Firm* — Price & Adams

(57) ABSTRACT

A plurality of trays or shelves are adjacently connected to one another and mounted on a frame to rollout and drop down from a stored position in a cabinet to a display position out of the cabinet in a progressively elevated series of connected trays. The series of trays extending from a front tray to a back tray are hingedly connected to one another and slidable on guide tracks of a frame that is secured to the interior base of the cabinet. Link arms positioned laterally of the trays are connected to sidewalls of each tray. The trays move together as a unit on the guide tracks out of the cabinet to a point where the back tray is restrained from further movement out of the cabinet. The link arms pivot downwardly so that the trays slide forwardly in slots of the arms and drop vertically down to progressively elevated heights relative to one another in a tiered arrangement. In the display position all the containers in the trays are visible because none are concealed one behind the other. The trays are lifted upwardly to a horizontal position opposite the cabinet and then pushed back into the cabinet to the stored position.

9 Claims, 11 Drawing Sheets

ROLLOUT DROP DOWN SHELVES

BACKGROUND OF THE INVENTION

1. Field of the Invention

This invention relates to storage and display shelf apparatus and more particularly to an assembly of individual shelves pivotally connected together in back-to-back relationship where the shelves are slidable into and out of a cabinet and when removed from the cabinet drop down in a tiered arrangement so that each shelf is at a different height to provide an obstructed view of the contents on all of the shelves.

2. Description of the Prior Art

The storage of items and products in the home, and particularly in the kitchen, is the subject of a wide variety of solutions most commonly embodied in cabinets, such as kitchen cabinets, which include a wide array of configurations and accessories that facilitate access to food items, kitchen utensils, and cooking preparations such as herbs, seasonings and spices. These items are commonly stored in cupboards, drawers, and on countertops of the kitchen.

Of particular interest in the organization of a kitchen is the storage of food preparation condiments, which commonly include herbs, seasonings, and spices stored in small bottles or containers. It is common in many kitchens to have an extensive supply of these products, which create problems in finding storage space and organizing the storage space so a desired seasoning or spice can be easily located. When the storage space becomes disorganized, it is difficult to efficiently locate the ingredients that are needed for the food preparation.

A number of solutions have been proposed for the storage and display of containers for seasonings. One of the most popular items utilized to organize a countertop is the Lazy Susan where herb and spice bottles and the like are placed on a rotatable round board. In most cases, the board becomes packed tightly with containers. Because the containers are of different size and are on the same level, their labels are concealed, and it is difficult to find the desired container. This problem is particularly acute when a Lazy Susan is positioned in an elevated position inside a cabinet where it becomes virtually impossible to identify any of the containers beyond those that are on the periphery of the tray.

One of the most common storage devices for organizing containers for herbs and spices is a conventional spice tray formed from a series of vertical shelves in a rack. The shelves take up counterspace. In most cases, they must be mounted to the countertop or to a vertical wall in back of the counter. Spice racks are efficient for a small number of containers, but for the storage of a large number of containers, which generally accumulate over a period of time in the kitchen, the conventional spice rack is not efficient. It is also known to attach a spice rack to the inside door of a cabinet, but this arrangement takes up interior storage space within the cabinet.

It has also been proposed to utilize the space under a kitchen cabinet so that the spice tray is elevated above the countertop. The tray is connected to the bottom of the cabinet and has limited capacity.

Attempts to improve the design and construction of under the counter storage racks and, particularly, spice racks are disclosed in U.S. Pat. Nos. 5,244,272; 5,957,558; and 7,168,773. U.S. Pat. No. 5,244,272 discloses an undercabinet spice jar drawer having a rectangular tray with multiple traverse, semi-cylindrical channels for holding jars in lateral rows. The tray has two raised, long side flanges, each having a notch near the rear. The flanges of the tray slide into two side rails of a mounting bracket. The front ends of the rails have sloped portions, which terminate in deep cradles. The tray is opened by pulling it straight out until the notches are over the cradles. The front of the tray is then lowered into the rear edges of the notches to engage the bottom of the cradles. The rear ends of the flanges engage the top of the mounting brackets except that the tray is angled downwardly about 45 degrees to provide convenient viewing and access to the spice jars.

U.S. Pat. No. 5,957,558 discloses a spice rack movable on a frame from a stored position to an extended position and then into a pivoted position where the drawer is perpendicular to the storage position. The storage cabinet is mounted to the underside or inside of the kitchen cabinet, preferably to the underside of the cabinet. The unit includes a frame that forms a storage region within the frame walls. The drawer is adapted to move out of the stored position to an extended position. The unit includes a frame that forms a storage region within the frame walls. The drawer is adapted to move out of the stored position to an extended position and thereafter, into a pivoted position. In the pivoted position, the tray is positioned vertically so to allow sufficient access to the containers stored on the trays.

U.S. Pat. No. 7,168,773 discloses a drawer expander having a plurality of trays stacked vertically on top of each other. Spring-biased arms connect the trays together so that the trays open when the drawer is opened and closed when the drawer is closed. The trays in an open position are staggered horizontally, one above the other.

U.S. Pat. No. 5,871,107 discloses a spice keeper associated with a kitchen cabinet that accommodates spices in cans or bottles of various sizes and shapes. The spice keeper is mounted within the underside perimeters of a kitchen wall cabinet with the purpose of eliminating the frustrations of storing spices on a kitchen cabinet shelf, in a kitchen cabinet drawer, or on a kitchen countertop and in racks hung on a kitchen cabinet door.

U.S. Pat. No. 1,568,212 discloses a silver chest formed by a plurality of drawers that may be readily withdrawn from the casing with a single operation and may be returned to the casing by single operation. Three drawers are pushed into the casing in the closed position. The operator by means of a knob pulls outward on the lowermost drawer. An ear piece slides on a rod of the drawer directly above it until it strikes a front piece causing the drawer to move outward into an open position. In the outermost position, the ear slides on the rod until it engages another part, which causes the ear to slide on the rod into an outward position. This movement results in a staggered array of drawers in a step-like configuration that makes them readily accessible.

U.S. Pat. No. 264,748 discloses a receptacle for letters, papers, money, or other articles for which files and drawers are usually employed. The receptacle is arranged to fit and slide in the compartment of a case. The receptacle consists of a series of smaller receptacles, such as trays, boxes, or packets. Two series of arm members are connected to the tray so that the trays can be folded one against the other. In a fully extended position the trays are in a step configuration where one tray is above the other.

U.S. Pat. No. 1,985,593 is another example of a cabinet having a plurality of pivotally mounted compartments. The compartments can be individually withdrawn, tilted, or even inverted without disturbing the other compartments. Any one of the trays in the cabinet can be withdrawn on its pivot and adopted in cooperation with the adjacent closed compartment to remain in a substantially horizontal and opened position beyond the vertical plane of the front face of the other compartments.

U.S. Pat. Nos. 886,066 and 4,874,211 disclose an array of connected trays and containers or compartments that are supported by a removable frame that permits the trays and compartments to be pivoted to a position where the individual trays or containers are accessible from a stored position to a displayed position.

U.S. Pat. No. 1,019,850 is an example of a display box formed by a series of trays that are initially nested in a main receptacle. The trays are connected so that they can be raised to produce a stair-effect. The trays are connected by a linkage comprising a pair of links on each side of the tray. A link arm is pivotally connected to the end wall of a front tray and has a slotted end for engaging a stud on another tray. A second link is pivotally connected to one tray and also has slotted ends for engaging studs on other trays. With this arrangement, the trays are movable from a stored horizontal position to a vertically raised position where one tray is at a higher elevation than the tray below it so as to make each tray readily assessable and the contents on the tray visible.

While it is known to provide storage racks and shelving for the storage and display of spice containers, as well as, containers for other objects that need to be efficiently stored and displayed, a number of known devices rely upon the attachment of the storage unit to the exterior of a cabinet, such as under a cabinet. However, under the cabinet trays have a limited capacity in either a horizontal or a vertical position. When storage trays are positioned inside a cabinet, locating a desired container is difficult because the support rack is not removable within the cabinet other than a Lazy Susan-type rotary tray. Therefore, there is need for a storage and display shelf that can retain a significant quantity of items in a cabinet out of sight and when desired to access the stored items, the shelf can be moved to a position where all the items are clearly identified for retrieval and replacement on the shelf.

SUMMARY OF THE INVENTION

In accordance with the present invention, there is provided storage and display shelf apparatus for positioning on a support structure that includes a pair of guide tracks supported in spaced parallel relation for mounting on the support structure. The guide tracks have a front end portion and a rearward end portion. A plurality of guide wheels is supported by the guide tracks. An assembly of shelves is positioned one behind the other extending from a front shelf to a back shelf between the guide tracks. Each of the shelves has a receptacle for receiving an item to be stored and displayed. A set of guide wheels is carried on the back shelf for engagement with the guide tracks for movement of the shelves on the guide tracks from a stored position on the guide tracks to a display position relative to the guide tracks. Each of the shelves has a boss extending from opposite ends thereof in alignment with a boss extending from opposite ends of an adjacent shelf. A hinge pin extends through the aligned bosses to connect adjacent shelves. A spring surrounding the hinge pin and positioned between the aligned bosses exerts an upward biasing force upon the shelves when positioned on the guide tracks. A trunnion extends outwardly from an upper end of the hinge pin above the aligned bosses. A link arm is positioned on each side of the assembly of shelves extending parallel to the guide tracks. The link arm has a front end and a rearward end with a series of spaced apart slots extending between the front end and the rearward end. The link arm rearward end is pivotally connected to the rearward shelf. The trunnion of the hinge pin is positioned in the respective slot of the link arm to connect the link arm to the shelves. The link arm is pivotal on the rearward shelf upon movement of the assembly of shelves in the stored positioned on the guide tracks to the display position where the shelves forward of the back shelf move off of the guide tracks and the trunnions move forward in the link arm slots so that the shelves drop down to a vertically displaced position compressing the spring where each shelf is maintained at a different height by the pivoted position of the link arm.

Further, in accordance with the present invention, there is provided a method for movably supporting an assembly of storage trays in a cabinet that includes the step of positioning an assembly of individual trays from a front tray to a back tray in front to back relation in a cabinet. The assembly of trays is movably supported on a track in the cabinet. Adjacent trays are connected for movement of the assembly as a unit from a stored position in the cabinet to a display position outside of the cabinet. The assembly of trays are strapped together from the front tray to the back tray to permit relative movement between adjacent trays. The assembly of trays moves as a unit from the stored position to the display position where each tray in the assembly remains connected to an adjacent tray and drops to a elevation below the adjacent tray from the front tray to the back tray so that the trays are positioned in a tiered arrangement.

Further, the present invention is directed to a rollout drop down storage unit that includes a frame having guide tracks for positioning on a horizontal surface. A plurality of trays are positioned in back-to-back relationship between a front tray and a back tray for rolling movement on the guide tracks between a stored position on the horizontal surface and a display position relative to the horizontal surface. Each of the trays is hingedly connected to an adjacent tray for relative vertical movement of the trays in the display position. A linkage is pivotally connected to one end to the back tray and movably connected to the other of the trays. The linkage is movable in a horizontal position with the trays from the stored position to the display position where forward movement of the back tray is stopped on the frame. The linkage is pivotal downwardly to allow the front tray and the other of the trays to drop vertically along the length of the linkage to progressive elevated positions where the front tray is at a lowest position on the linkage to the back tray at the highest position on the linkage forming a tiered arrangement of the trays.

Accordingly, a principal object of the present invention is to provide an assembly of storage trays positioned in back-to-back relation for movement in a cabinet from a stored position to a display position outside of the cabinet where each tray drops to an elevation below an adjacent tray so that the trays are positioned in tiers to allow efficient access to the contents of the trays.

Another object of the present invention is to provide a storage unit that facilitates the efficient storage of containers in a cabinet on trays and allows efficient access to the contents on the trays by moving the trays outside of the cabinet and dropping the trays to a position where each tray can be viewed individually for the contents on the tray.

A further object of the present invention is to provide a storage system that efficiently organizes contents of a cabinet while permitting access to the contents by moving the contents stored in trays from inside the cabinet to outside of the cabinet where all the contents can be efficiently examined.

An additional object of the present invention is to provide a storage tray that is movable from a position inside a cabinet to a position outside and dropped down below the cabinet for efficient access to the contents of the cabinet.

These and other objects of the present invention will be more completely disclosed and described in the following specification, the accompanying drawings, and the appended claims.

DESCRIPTION OF THE PREFERRED EMBODIMENTS

Figure 1:
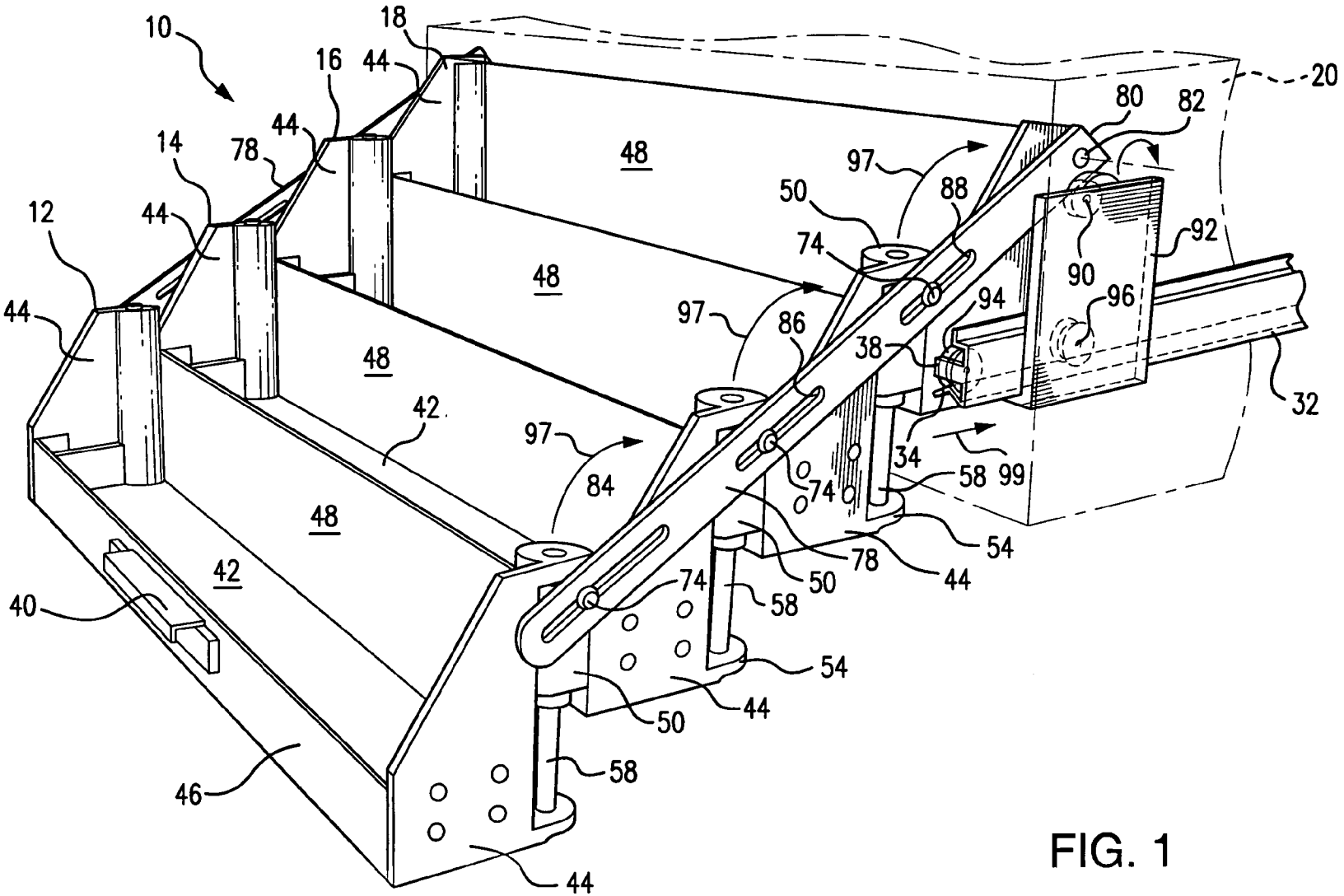
FIG. 1 is an isometric view in side elevation of a shelf apparatus formed of a plurality of adjacently connected trays, illustrating the trays in a rolled out, drop down position removed from a cabinet illustrated in phantom.
Figure 2:
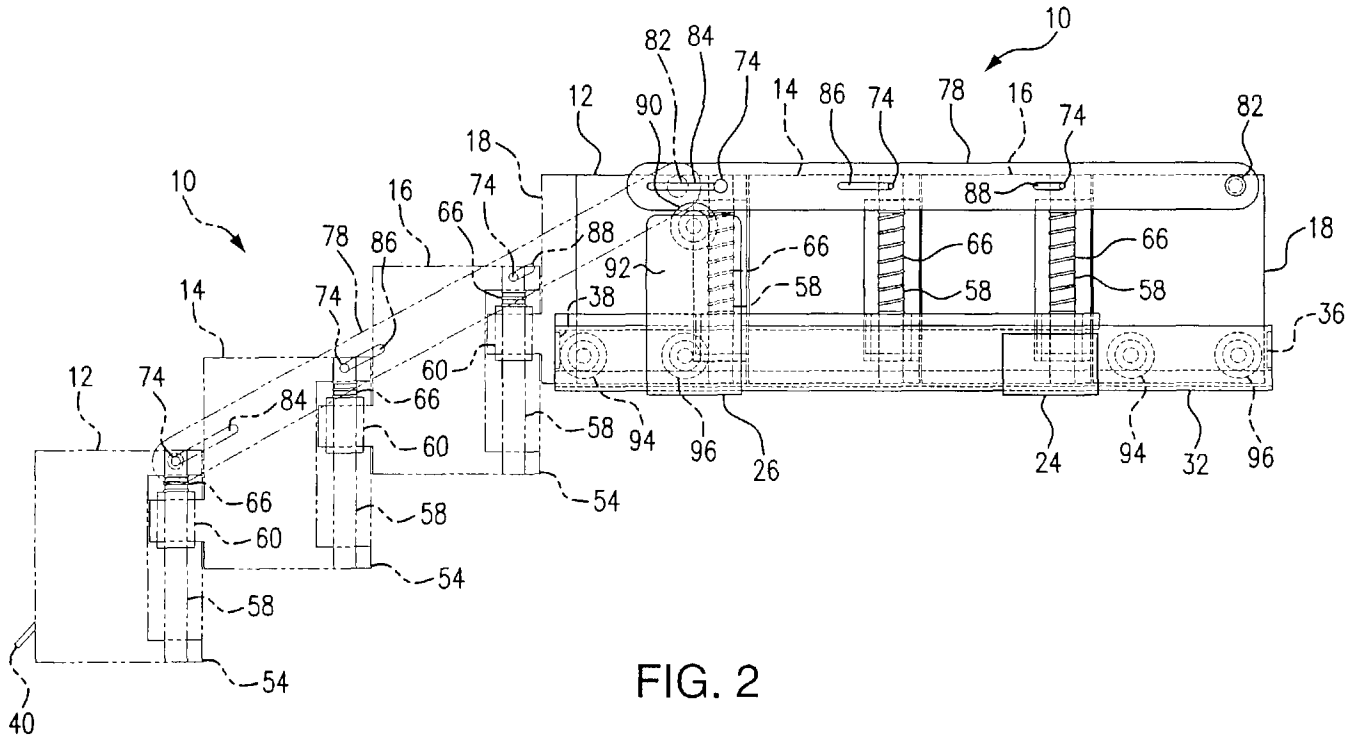
FIG. 2 is a view in side elevation of the shelf apparatus shown in FIG. 1, illustrating the trays positioned in side-by-side relation in a stored position and illustrated in phantom in a display position where the trays are dropped down to progressively elevated positions in a tiered arrangement.

Referring to the drawings and particularly to FIGS. 1-6, there is illustrated a shelf apparatus generally designated by the numeral 10 formed of a plurality of individual storage trays or shelves 12, 14, 16, and 18 that are adjacently connected for relative movement to a drop down position outside of a support structure 20, such as a kitchen cabinet, as shown in FIG. 1 from a stored position in the support structure 20, as shown in FIG. 2. The support structure or cabinet 20 is not shown in FIG. 2; however, it should be understood that the shelf apparatus 10 is adaptable for positioning in any storage unit or cabinet where it is desired to store individual items and display the items for retrieval.

One example of use of the present invention is the storage of small containers such as, jars and cans that include spices, condiments, and seasonings in a kitchen. The shelf apparatus 10 is also adaptable for storage of hardware parts, medical supplies, or any individual items in containers. In accordance with the present invention, the shelf apparatus is easily moved out of the cabinet 20 where the trays 12-18 containing the items remain connected to one another and drop down to a progressively elevated arrangement of connected trays in a display position. Thus the trays 12-18 forming the shelf apparatus 10 are stored in a compact side to side position, as shown in FIG. 2, within the cabinet and are movable to a position outside the cabinet in an expanded display position. In the display position the trays 12-18 provide efficient access to all the contents of the cabinet displaced from the interior of the cabinet.

The shelf apparatus 10 is movable into and out of the cabinet from the stored position shown in solid lines in FIG. 2 to the display position shown in phantom in FIG. 2 and in FIG. 1. A frame generally designated by the numeral 22 shown in FIG. 4 supports the shelf apparatus 10, including the trays 10-18, for slidable movement into and out of the cabinet 20. The trays 12-18 remain connected to the cabinet 20 in the display position shown in FIG. 1. The frame 22 includes a pair of parallel spaced cross plates 24 and 26 of a length selected for the width of the cabinet to allow for unobstructed movement of the shelf apparatus 10 into and out of the cabinet.

Preferably, the cross plates 24 and 26 are suitably secured by fasteners 28 to the base of the cabinet. Thus, the cross plates 24, 26 remain secured to the base of the cabinet. Connected perpendicular to the cross plates 24 and 26 are a pair of parallel spaced guide tracks 30 and 22 positioned to provide unobstructed travel of the trays 12-18 into and out of the cabinet 20. The guide tracks 30 and 32 support all the trays 12-18 in the stored position. The spacing between the guide tracks 30 and 32 is determined by the width of the opening into the cabinet 20.

Figure 4:
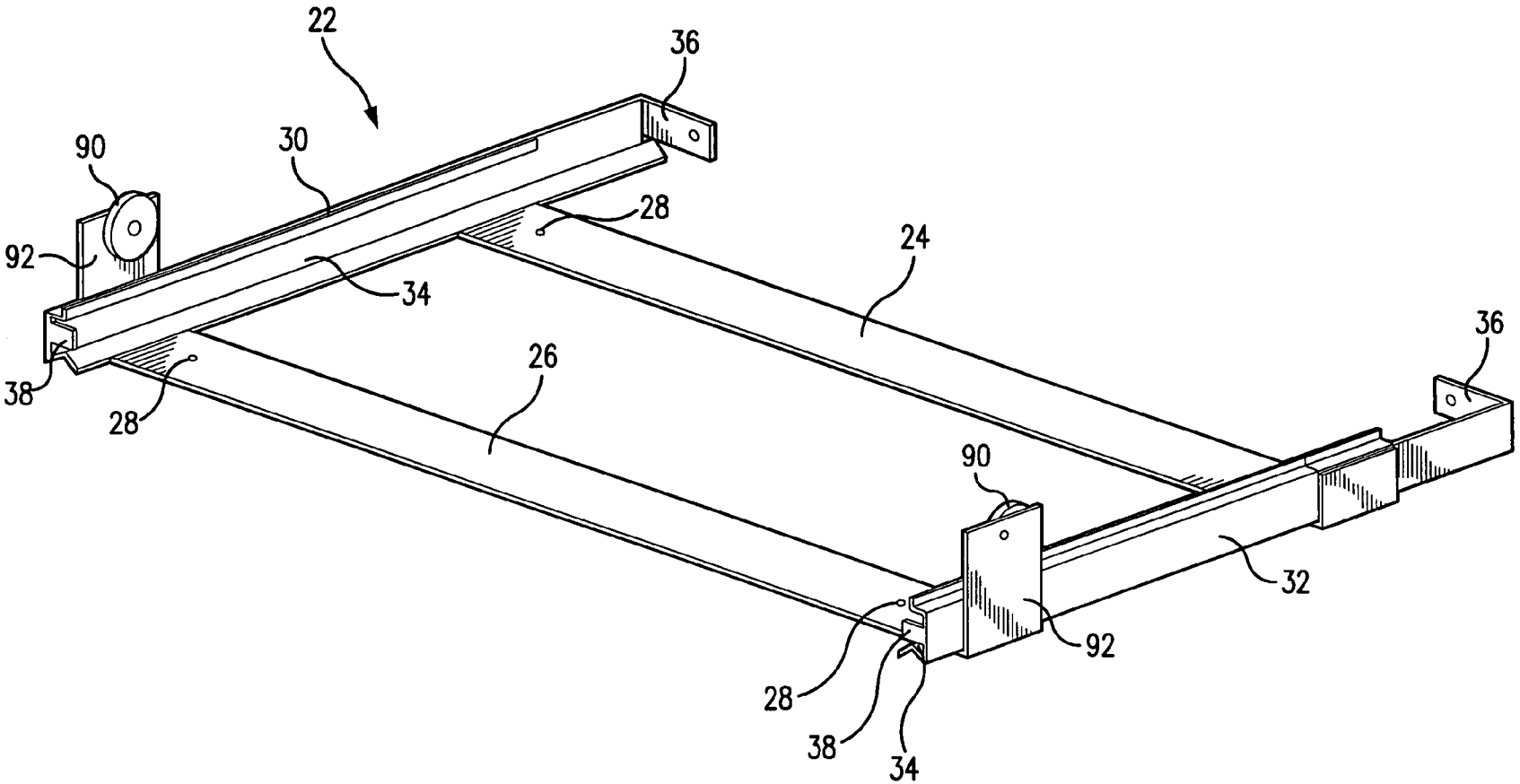
FIG. 4 is an isometric view in side elevation of a frame for positioning in a cabinet to support the shelf apparatus for movement from a stored position in the cabinet to a display position outside of the cabinet.
Figure 5:
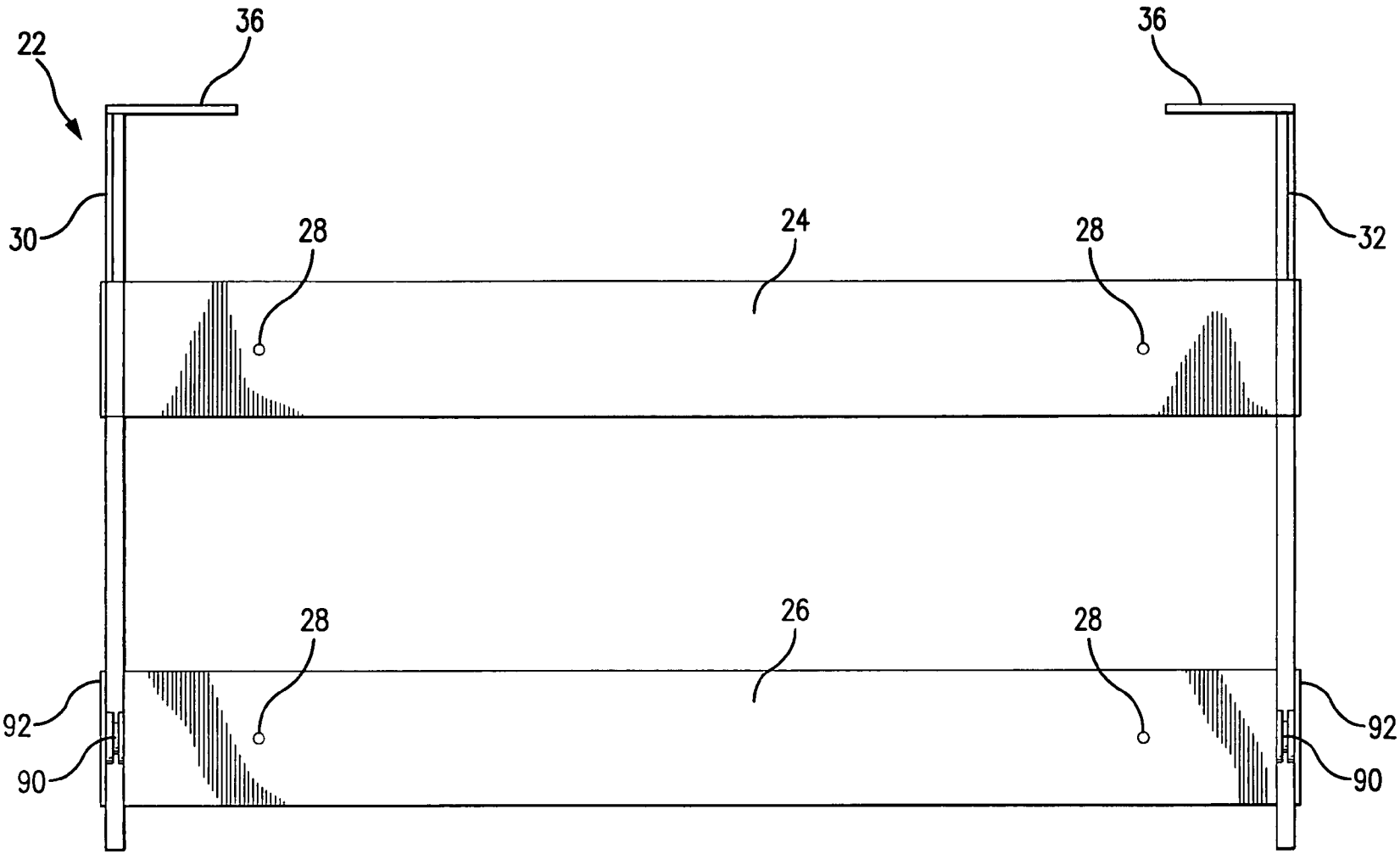
FIG. 5 is a top plan view of the frame shown FIG. 4.

As shown in FIG. 4, the guide tracks 30 and 32 each include a longitudinally extending channel 34 that receives rollers or wheels mounted on the side walls of the selected ones of the trays 12-18 for guiding movement of the trays on the guide tracks 30 and 32 from the stored position within the cabinet 20 to the display position outside the cabinet 20.

The translational movement of the trays 12-18 on the guide tracks 30 and 32 is limited to the length of the tracks 30 and 32 by the provision of stops 36 and 38 projecting from the ends of each track 30 and 32. The stops 36 and 38 obstruct the movement of the rollers in the channels. When the rollers strike the back stops 36, the shelf apparatus 10 has been returned to the stored position in the cabinet whereby the cabinet door can be closed to conceal the stored trays 12-18. When the roller on the back tray 18 contacts the forward stops 38, the forward movement of the shelf apparatus 10 on the guide tracks 30 and 32 is stopped. The shelf apparatus 10 is then secured in the display position where the trays 12-16 drop down from the base of the cabinet for positioning in a tiered or a step arrangement. The tray 18 remains on the base of the cabinet 20. In the display position the trays 12, 14, 16, and 18 are progressively elevated one above the other in a tiered arrangement. The front tray 12 is at the lowest elevation and the back tray 18 is at the highest elevation inside the cabinet. The elevation progresses upwardly in the display position from the front tray 12 to the back tray 18. The back tray 18 remains at the elevation of the base of the cabinet in both the stored and display position and is retained by the stops 38 on the guide tracks 30 and 32 in the cabinet.

Now referring to FIGS. 1, 2, 3, and 6, the shelf apparatus 10, as shown in FIG. 1, is rolled out from the cabinet or support structure 20 on the guide tracks 32 and 34, to drop down in front of and out of the cabinet 20. The final or display position of the shelves or trays 12-18 is illustrated in FIGS. 1 and 2. In the display position, the trays 12, 14, and 16 are completely removed from the cabinet; while, the tray 18 remains within the cabinet on the guide tracks 30 and 32. In FIG. 2, the display position of the trays 12-18 is shown in phantom and the stored position of the trays 12-18 in the cabinet is shown in solid lines.

When the shelf apparatus 10 is extended out and lowered down to the display position, the trays 12-18 are positioned adjacent to one another at progressively elevated positions which can also be referred to as a tiered or stair-effect. In this position of the shelf apparatus 10, the contents of the trays, such as spice jars, are efficiently identified for retrieval and returned to their designated positions on the trays. With the embodiment shown in FIG. 1 four levels of trays or shelves are available for storage of containers where a selected container can be easily removed and replaced without moving any of the other containers.

Each tray 12-18 is at a different elevation in the display position so that all the spice jars in each tray are clearly visible. Specifically, spice jars stored on the lowermost tray 12 are not obstructed or hidden from view by spice jars on the second tray 14. This also applies to the jars in the trays 16 and 18, which are at progressively higher elevations above the trays 12 and 14. In the tiered arrangement, each jar in each tray is clearly visible. A jar or container on one tray is not hidden behind a jar in a preceding tray.

When it is desired to retrieve a selected jar or container from one of the trays or shelves 12-18, the shelf apparatus 10 is rolled out of the cabinet and allowed to drop down to where each tray is at an elevation below the preceding tray. The desired container is located and removed from the respective tray. The shelf apparatus 10 is then lifted upward by grasping a handle 40 connected to the front tray 12 to move the trays from the display or tiered position upward to a horizontal position where the trays are all on the same level opposite the tracks 30 and 32. The handle 40 is then pushed inward to advance the trays horizontally on the tracks 30 and 32 to the position shown in FIGS. 2 and 3. This corresponds to the stored position of the shelf apparatus 10 in the cabinet where each tray is positioned back-to-back at the same elevation.

In the final stored position in the cabinet, horizontal movement into the cabinet 20 is restrained by contact of the back of tray 18 with stops 36. Thus, the operator knows exactly when the trays have been returned to the stored position when horizontal movement of the shelf apparatus 10 is restrained in the cabinet. Similarly, the operator knows exactly when the trays are in the final display position. This occurs when the trays have rolled out and dropped down. No further outward movement of the back tray 18 is permitted by contact of guide wheels on the sidewalls of the back tray 18 with front stops 38, as shown in FIG. 1. Therefore, the stops 36 and 38 limit movement of the shelf apparatus 10 between the stored position in the cabinet and the display position out of the cabinet.

Now referring to FIG. 1, each tray 12-18 includes a bottom wall 42, two sidewalls 44, a front wall 46, and a back wall 48 to form a receptacle for receiving items to be stored and displayed in the tray. The trays 12-18 can be fabricated of a suitable material, such as sheet metal. They can also be formed of a polymeric material by injection molding. The tray components also can be formed by plastic extrusion. The components can further be fabricated of a combination of metal and plastic. With all of these constructions, the length and the width of the trays are selective. Conventionally, the dimensions are coordinated with the various widths that are available for commercial kitchen cabinets and other commercial available cabinets.

Figure 3:
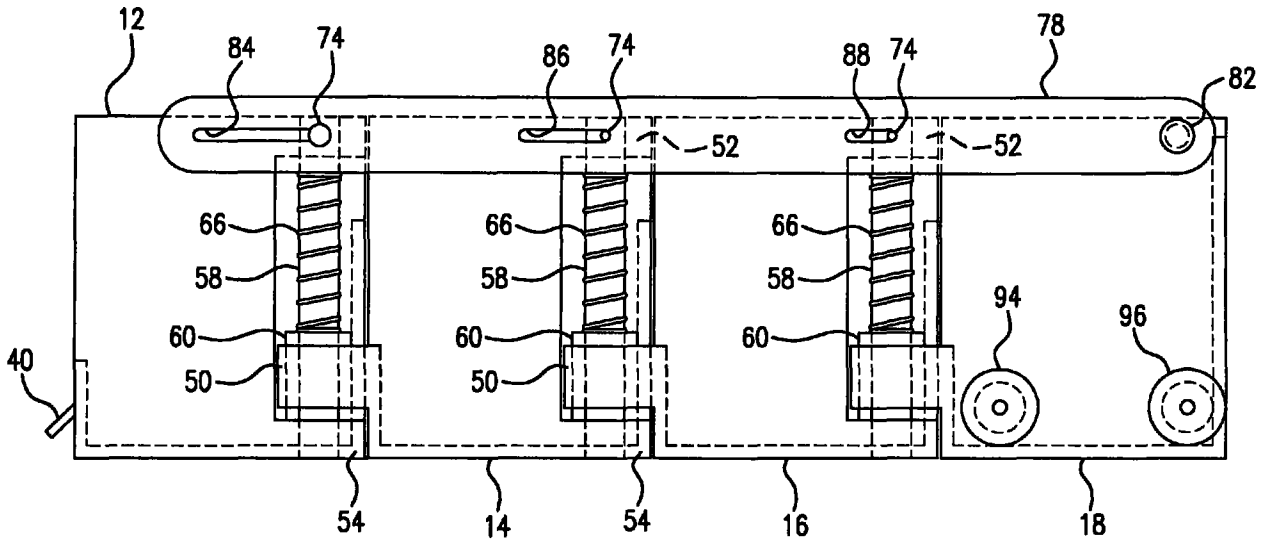
FIG. 3 is a view in side elevation of the shelf apparatus, illustrating trays positioned in back-to-back relation in the stored position where each tray is connected to an adjacent tray and movable on a link arm connected to the adjacent trays.
Figure 15:
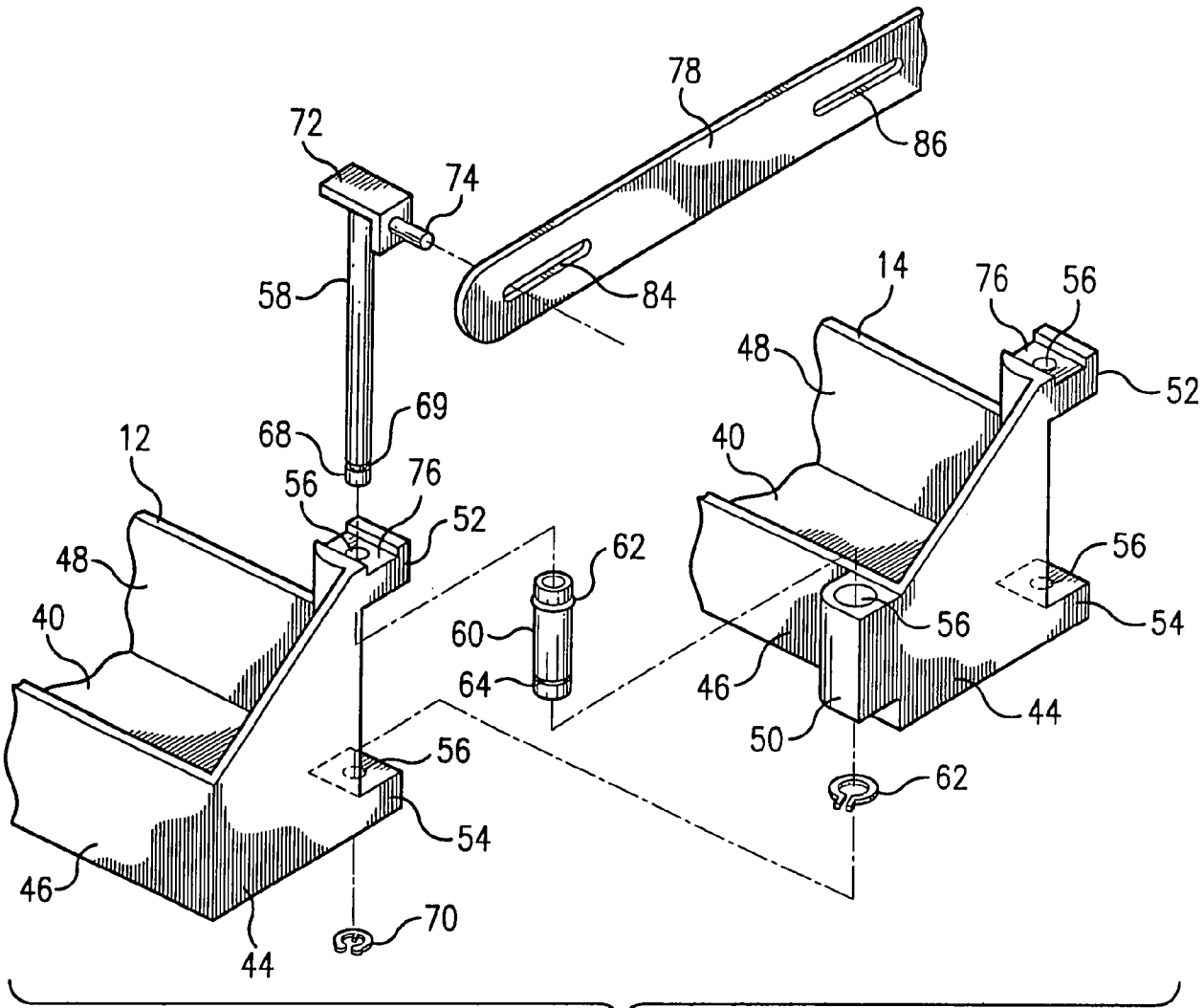
FIG. 15 is a fragmentary, exploded isometric view of the hinged connection for adjacent trays.

As illustrated in FIGS. 1, 3, and 15, the sidewalls of each shelf or tray are provided with a hinge-type connection to facilitate a connection of adjacent trays. Specifically, the connection of tray 12 to tray 14 is illustrated in FIG. 15. Each sidewall 44 of a tray or shelf includes front and rear bosses. For example, as shown for tray 14 in FIG. 15, each sidewall 44 includes an elongated front boss 50, a rear upper boss 52, and a rear lower boss 54 vertically aligned with the upper boss 52. Each of the trays, other than the front tray 12, has the combination of the front boss 50 and the aligned rear bosses 52 and 54. The front tray 12 does not include a front boss 50 because it is not connected to a tray in front of the tray 12.

To connect adjacent trays from back to front, for example as shown in FIG. 3, the back tray 18 is connected to tray 16. Tray 16 is connected to tray 14. Tray 14 is connected to tray 12. FIG. 15 illustrates the component parts that are used to hingedly connect adjacent trays. The same hinge connection is used to connect all adjacent trays. The hinge connection is accomplished by positioning the front boss 50 of tray 14 in alignment with the upper and lower rear bosses 52 and 54 of tray 12 so that the bores 56 through the bosses 52 and 54 are aligned with bores 56 through the boss 50 of the tray 14. The boss 50 is aligned with the bosses 52 and 54 to receive a hinge pin 58. However, prior to assertion of the hinge pin 58 in the aligned bores 56, a linear bearing 60 is positioned in the bore 56 of the front boss 50. The linear bearing 60 is retained in the front boss 50 by provision of retainer rings 62 that are engaged within angular recesses 64 at opposite ends of the linear bearing 60. A conventional coil spring 66, as illustrated in FIGS. 2 and 3, is positioned above the linear bearing 60 in the front boss 50 in alignment with the bore 56 of the rear upper boss 52 of the tray 12.

With the spring 66 aligned with the bores 56 of bosses 50 and 52, the hinge pin 58 is advanced downwardly through the boss 52 through the center of the spring 66, through the linear bearing 60 in boss 50, and downwardly through the bore 56 of the rear lower boss 54. Lower end portion 68 of pin 58 extends out of the lower boss 54 where a retainer clip 70 engages an annular recess 69 on the pin lower end portion 68 to retain the pin 58 in the aligned bosses 50, 52, and 54 to hingedly connect the tray 12 to the tray 14. As illustrated in FIGS. 2 and 3, the coil spring 66 abuts at one end the linear bearing 60 retained in boss 50 and at the opposite end the upper boss 52. Thus, the spring 66 exerts an upward biasing force upon the tray 12 through the boss 52.

As further shown in FIG. 15, the hinge pin 58 includes a cap 72 at the upper end thereof and a trunnion 74 extends outwardly from the cap 72. To prevent rotational movement of the hinge pin 58 in the aligned bores 56, the cap 72 is retained in a slotted recess 76 in the rear upper boss 52. Engagement of the cap 72 in the slotted recess 76 prevents rotation of the hinge pin 58. With the positioning of the hinge pin 58 in the bores of the aligned bosses 50, 52, and 54 adjacent trays are connected to one another. The connection of tray 12 to tray 14 is shown in detail in FIG. 15. FIGS. 2 and 3 illustrate the hinge pin connection of tray 14 to tray 16 and the connection of the tray 16 to the back tray 18. The connection of the adjacent trays from the front tray 12 to the back tray 18 is accomplished by the aligned adjacent bosses connected by the hinge pin 58. Also, in each connection of adjacent trays, the coil spring 66 is compressed between the linear bearing 60 retained in the boss 50 and the bottom of the rear upper boss 52.

In addition to adjacent trays being connected by the above-described hinge pin connection, the trays 12-18 are tied together by a linkage formed by a pair of link arms 78. Each link arm 78 is pivotally connected at back end 80 by a pivot pin 82 to the upper end of sidewall 44 of the back tray 18, as shown in FIGS. 1-3. With this arrangement, the pair of link arms 78 extends forwardly from the pivot pins 82 adjacent the sidewalls 44 of each of the trays from the back tray 18 to the front tray 12. Each link arm 78 includes spaced apart longitudinally extending slots 84, 86, and 88 along the length of the link arm. With the link arms 78 pivotally connected to the back tray 18 and the arms extending forwardly opposite the sidewalls 44 of each tray, the respective slots 84, 86 and 88 are aligned to receive the trunnion 74 that extends from each hinge pin 58 to connect adjacent trays.

As shown in FIGS. 1 and 2, slot 84 in arm 78 is positioned to receive the trunnion 74 extending from the hinge pin connection of tray 12 to tray 14. Slot 86 receives the trunnion 74 that extends from the hinge pin connection of tray 14 to tray 16. The slot 88 receives the trunnion 74 that extends from the hinge pin connection of the tray 16 to the tray 18.

The slots 84, 86, and 88 in the link arms 78 have different lengths. The differing lengths of the slots 84-88 are shown in FIGS. 2 and 3. The length of the slot 84 is greater than the length of the slot 86. The length of the slot 86 is greater than the length of the slot 88. In accordance with the present invention, movement of the trunnions 74 in the respective link arm slots 84-88 guides the movement of the trays 12-18 between the display and stored positions.

Figure 6:
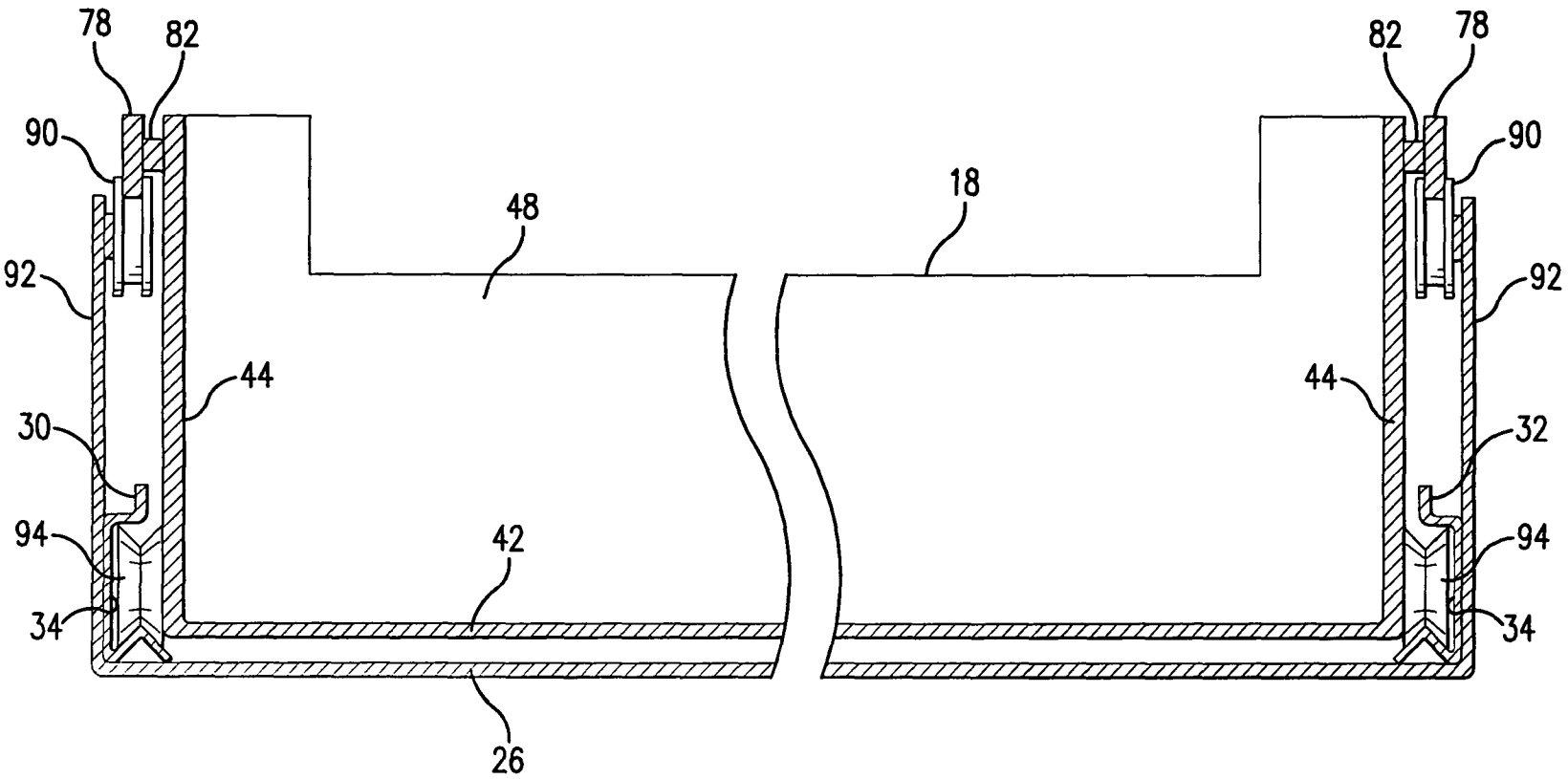
FIG. 6 is a fragmentary sectional, front elevational view, illustrating one of the trays of the shelf apparatus supported for movement by wheels in tracks of the frame for movement into and out of the cabinet.

The provision of the pair of link arms 78 serves to stabilize the connection of the trays 12-18 one to another and provides for uniform movement of all the trays as a unit between the stored position and the display position. The trays are returned from the display position shown in FIG. 1 to the stored position shown in solid lines in FIG. 2. The connection of the link arms 78 to each of the storage trays or shelves of the shelf apparatus 10 is stabilized by movement of the link arms 78 on guide wheels 90 rotatably mounted on plates 92 that extend upwardly from the frame cross plate 26 adjacent the channel stops 38 at the front of the frame 22, as shown in FIGS. 1 and 4. The stops 38 close the open ends of the front of the channels 32 and 34. FIG. 6 illustrates the positioning of the link arms 78 on the guide wheels 90.

As illustrated in FIG. 2, when the shelf apparatus 10 is in the stored position in the cabinet or other suitable storage unit, the forward ends of the link arms 78 are positioned on the guide wheels 90. The link arms 78 are positioned in a substantially horizontal position with the rearward end of the link arms pivotally connected by pivot pins 82 to the sidewalls 44 of the back tray 18. As the shelf apparatus 10 is rolled out of the cabinet from the stored position to the display position, which is illustrated in phantom in FIG. 2, the link arms 78 move on the guide wheels 90.

When the shelf apparatus 10 is fully extended from the cabinet, no further movement out of the cabinet is permitted by engagement with the stops 38 on frame 22. The trays 12, 14, and drop down vertically as the link arms 78 pivot about the pins 82. In this position, the back end 80 of each link arm 78 is supported by a guide wheel 90 elevated above the guide tracks 30 and 32 on the frame 22. This position of the link arms 78 supported on the guide wheels 90 is shown in FIG. 6. In this position, the link arms 78 are supported by the guide wheels 90 at the point where the link arms 78 are pivotally connected to the back tray 18. Forward movement of the link arms 78 on the guide wheels 90 is restrained by contact of the channel stops 38 with guide wheels 94 that are rotatably mounted on the sidewalls 44 of the back storage tray 18. The position of the guide wheels 94 and 96 in the guide tracks 30 and 32 is shown in the display position in FIGS. 1 and 6.

The movement of the connected trays 12-18 along the guide tracks 30 and 32 is also stabilized by the provision of a second guide wheel 96 positioned rearward of the guide wheel 94 on the tray sidewall 44, as shown in FIGS. 2 and 3. Forward movement of the shelf apparatus 10 out of the cabinet 20 is restrained when the guide wheels 94 on the sidewalls 44 of the back tray 18 engage the channel stops 38 at the front of the frame 22. Thus, the guide wheels 94 and 96 are supported by the sidewalls 44 on the back tray 18 for movement within the guide tracks 30 and 32. The link arms 78 move on the rollers 90 supported by the upper extension 92 of cross plate 26 above the frame 22. With this arrangement the shelf apparatus 10 having the trays 12-18 filled with containers is stabilized as a unit and supported for unobstructed movement from the stored position in the cabinet to the display position out of the cabinet, as shown in the FIG. 2.

As illustrated in FIGS. 1 and 2, the shelf apparatus 10 is moved out of the cabinet 20 by the rolling action of the link arms 78 on the guide wheels 90 supported by the frame 22. The guide wheels 94 and 96 connected to the sidewalls 44 of the back tray 18 roll within the guide tracks 30 and 32 on the frame 22 which is secured to the base of the cabinet 20. When the trays 12-18 are positioned in the stored position in the cabinet 20 as shown in FIG. 3, the trays are positioned in close adjacent back-to-back relationship. All the trays are on the same level supported by the engagement of the guide wheels 94 and 96 with the guide tracks 30 and 32. The trays 12-18 are restrained against lateral movement by engagement of the guide wheels 94 and 96 with the guide tracks 30 and 32 and by the bracing action provided by the pivotal connection of the link arms 78 with the back storage tray 18. Further, the link arms 78 engage the other trays 12-16 by the positioning of the hinge pin trunnions 74 in the slots 84, 86, and 88 respectively of the link arms 78. In the initial stored position, as shown in FIG. 3, the link arms 78 are connected to the back tray 18 so that each of the trunnions 74 is positioned at the back of the link arm slots 84, 86, and 88.

To advance the shelf apparatus 10 out of the cabinet 20 to retrieve an item from one of the shelves 12-18, handle 40 extending from the front shelf 12 is pulled outwardly to rollout the shelves on the guide tracks 30 and 32 while the link arms 78 travel in parallel paths by movement on the guide wheels 90. In this regard, as shown in FIG. 6, the parallel movement of the link arms 78 with the shelves 12-18 is accomplished by the overlying positioning of the guide wheels 94 and 96 with the rollers 90.

As the shelves 12-18 advance together out of the cabinet 20, all the trays are maintained at the same elevation as they move out of the cabinet 20. The shelves 12-18 remain at the same elevation, one behind the other as the guide wheels 94 and 96 roll along the guide tracks 30 and 32 until the front guide wheels 94 on the shelf tray 18 contact the channel stops 38 on the frame 22 at the front of the cabinet. At this point, the shelves 12, 14, and 16 are positioned out of the cabinet and back shelf 18 is positioned on the front edge of the cabinet. All shelves are at the same elevation. At this point, the operator while grasping the handle 40 exerts a downward force on the shelves which actuates downward pivotal movement of the link arms 78 about the pivot pins 82 on the back shelf 18.

The downward pivotal movement of the link arms 78 results in forward movement of the trunnions 74 for each of the shelves 12, 14, and 16 in the respective slots 84, 86, and 88. Consequently, the downward pivotal movement of the link arms 78 combined with forward movement of the trunnions 74 in the respective slots of the link arms 78 permits the shelves 12, 14, and 16 to drop vertically. The movement of the trunnions 74 in the respective slots 84-88 determines the length of travel of the downward displacement of the shelves 12-16 to the position as shown in FIGS. 1 and 2. In the display position, the shelves form a tiered array where the shelves are progressively elevated in a series.

The forward movement of each shelf 12, 14, and 16 is determined by the length of travel of the trunnions 74 in the respective slots 84, 86, and 88. The longer the slot, the greater the forward linear movement of the shelf. In this respect, because the shelf 12 is the front shelf, a greater length of travel of the trunnion 74 is required to advance the shelf 12 on the link arm 74 so that it may fall vertically ahead of the shelf 14. The length of travel of the trunnion 74 for the shelf 14 in the link arm slot 86 is less than that of the length of travel of the trunnion 74 in the slot 84. Thus, the shelf 14 will fall vertically behind the tray 12 without contacting the tray 12. This also applies to the shelf 16 where the slot 88 for trunnion 74 has a shorter length than the length of the other slots 84 and 86 so that the forward movement of the shelf 16 on the link arms 78 is less than the length of the travel of the other shelves. In this manner the shelves 12-16 move vertically downward upon pivotal movement of the link arms 78 without movement of the shelves interfering with one another. A controlled horizontal and downward vertical movement of the shelves is accomplished so that when the shelves reach their final position for display of the contents of the shelf, each shelf is positioned at a different elevation. This allows the operator to view all of the contents of the shelves for identifying the particular item to be selected from all of the items stored in the shelves.

The downward vertical movement of the shelves 12, 14, and 16 relative to the back shelf 18 is actuated by downward pivotal movement of the link arms 78. As the link arms 78 pivot downwardly, the trunnions 74 advance in the respective slots 84, 86, and 88. Movement of the trunnions 74 in the slots permits relative downward movement of the shelves. For example, the shelf 12 moves downwardly relative to the shelf 14, and the shelf 14 moves downwardly relative to the shelf 16. The relative downward movement of each shelf is accomplished by the hinge pin connection of the adjacent shelves. For the shelf 12, the hinge pin 58 connects the shelf 12 to the shelf 14. As the link arms 78 pivot downwardly and the trunnions 74 advance forwardly in the slots 84, the shelf 12 moves vertically downwardly on the hinge pins 58 from the initial position, as shown in FIG. 2 when the shelf 12 is in the stored position, to the position on the hinge pins in the display position as shown in phantom in FIG. 2.

As above discussed, the coil springs 66 are positioned between the linear bearings 60 and the rear upper bosses 52 on the shelf 12. The presence of the springs retards the downward movement of the shelf 12 on the hinge pins 58. As seen in FIG. 2, the springs 66 are fully extended in the rest position when the shelves are stored in the cabinet. When the trays are removed from the cabinet, the resultant downward movement of the shelves compresses the springs which retards or cushions the downward movement of the shelves so that it is a gradual movement as opposed to a sudden drop in the elevation of the shelves. This facilitates ease of movement of the shelves as a unit into the display position.

The downward gradual movement of each of the shelves 12-16 assures that the contents of the shelves remain in position. The operator is not required to exert any effort to restrain the downward movement of the shelves to the display position. Similarly, the shelf 14 moves downwardly on its hinge pins 58 relative to the rearward adjacent shelf 16. Likewise, the shelf 16 moves downwardly on its hinge pins 58 relative to the shelf 18. The shelf 18 does not move downwardly as it remains supported at the elevation of the cabinet base on the guide tracks 30 and 32.

When it is desired to return the tiered array of shelves 12-18 to the stored position, the operator exerts an upward lifting force on the handle 40 in the direction indicated by the arrows 97 in FIG. 1. An upward lifting force removes the downward pressure exerted by the shelves 12, 14, and 16 on the coil springs 66. This allows the springs 66 to extend in length and to exert an upward force on the shelves to facilitate ease of returning the shelves to the cabinet 20. Thus the shelves 12-16 are raised to a completely elevated position which is at the elevation of the back shelf 18. In this position, the link arm 78 is in a horizontal position parallel to the guide tracks 30 and 32. The operator then pushes in the direction of arrow 99 in FIG. 1 on the handle 40 to advance the guide wheels 94 and 96 in the guide tracks 30 and 32 away from the channel stops 38. Movement of the shelves 12-18 is continued into the cabinet until the rear guide wheels 96 engage the channel stops 36 on the back of the frame 22. The channel stops 36 close the open end of the back of the channels 32 and 34. At this point, the shelf apparatus 10 is positioned inside the cabinet 20. The cabinet 20 can then be closed, thereby concealing the shelf apparatus.

Figure 7:
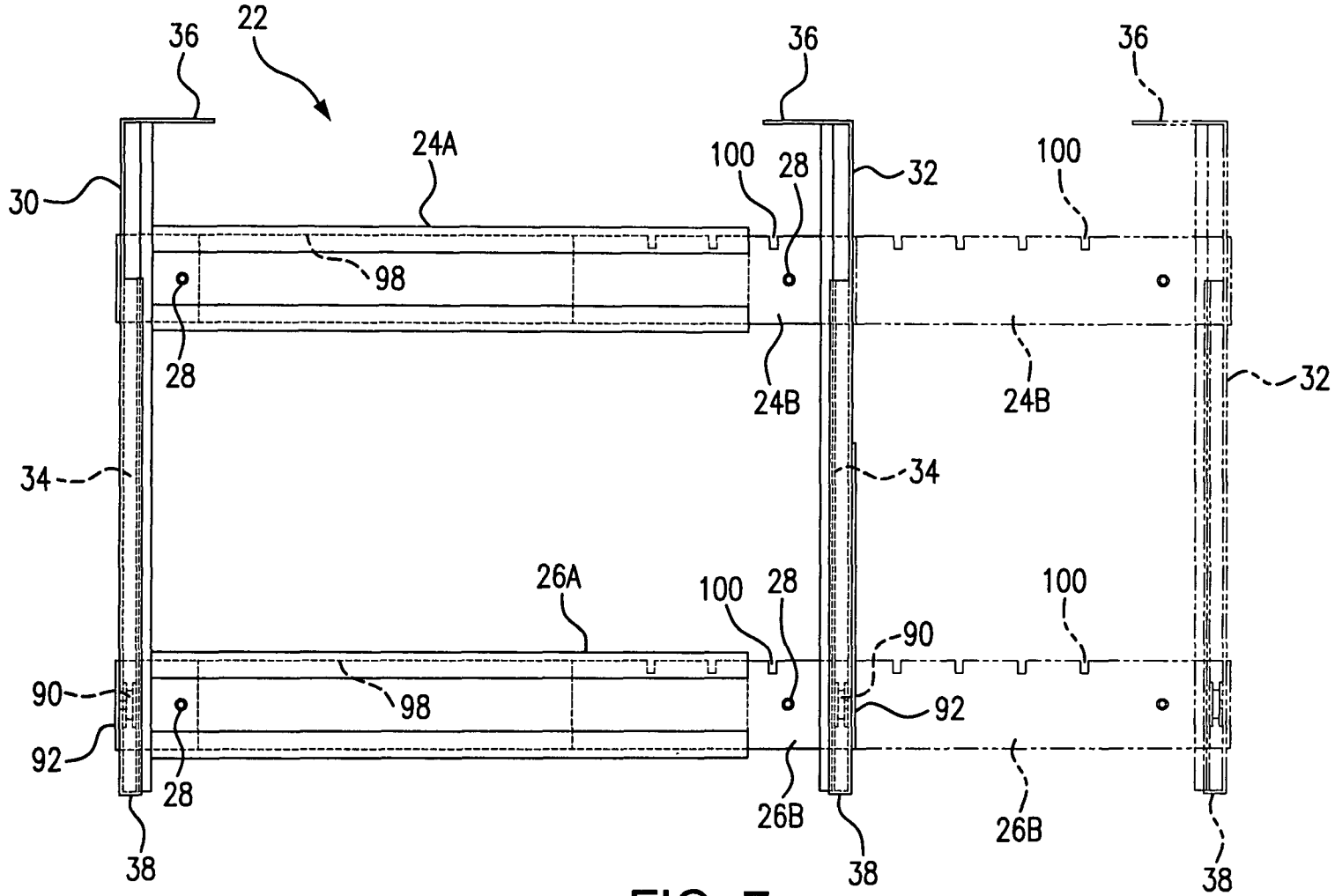
FIG. 7 is a top plan view of an embodiment of the frame for supporting the shelf apparatus, illustrating adjustments in the width of the frame to accommodate different tray sizes, illustrating in phantom an expanded width of the frame.

Now referring to FIG. 7, there is illustrated a second embodiment of the frame 22 for movably supporting the shelf apparatus 10 for movement into and out of the storage cabinet 20 where like numerals identified in FIG. 4 refer to like elements shown in FIG. 7. With the embodiment of the frame shown in FIG. 7, the width of the frame between the guide tracks 30 and 22 is adjustable to accommodate the width of the cabinet in which the frame 22 is positioned.

It is well known that the cabinets, such as kitchen cabinets, are supplied in standard widths that conventionally range from 9 inches to 48 inches in 3 inch increments. Examples of conventional cabinet widths are 9 to 15 inches, 15 to 21 inches, 24 to 30 inches, and 33 to 39 inches. While the frame 22 can be fabricated for a specific width of cabinet, the present invention also includes the provision of being able to adjust the width of the frame 22 so that one frame can be supplied for installation in any standard cabinet having a width in the above example ranges. A frame 22 can be installed to be adjustable in width, for example, from 15 inches to 18 inches to 21 inches.

The frame 22 shown in FIG. 7 includes the above-described guide tracks 30 and 32 provided with channels 34 for receiving the guide rollers 94 and 96 on the back tray 18. The travel of the back tray on the tracks 30 and 32 is limited by the channel stops 36 and 38 positioned at the back and front of the tracks 30 and 32. With this embodiment, rather than having cross plates 24 and 26 of fixed length, the cross plates include telescopic components 24A and 24B for the back cross plate and components 26A and 26B for the front cross plate. The telescopic arrangement of the cross plates 24A, 24B and 26A, 26B is identical. The cross plates 24A and 26A are secured to the guide tracks 30, and the cross plates 24B and 26B are secured to the guide tracks 32. Each of the guide tracks 24A and 26A has an internal channel that extends the length of the cross plate to receive the respective cross plates 24B and 26B. Specifically, with respect to cross plate 24A, the internal channel is provide with a plurality of protuberances spaced a preselected distance along the length of channel 98 from the open end portion of the channel.

The cross plate 24B shown in FIG. 7 is provided with a plurality of indentations or recessions 100 positioned on one edge thereof, spaced a distance apart corresponding to the spacing of the protuberances within the channel 98 of the cross plate 24A. With this arrangement, the cross plate 24B is movable within the channel 98 of cross plate 24A to provide a preselected width between the guide tracks 30 and 32. Once the guide tracks 30 and 32 are spaced a selected distance apart, the indentations 100 on the cross plate 24B engage the protuberances within the channel 98 of the cross plate 24A to secure the position of the guide tracks 30 and 32 at the desired distance apart.

As shown in FIG. 7 by the solid lines, the cross plate 24B extends into the channel 98 of cross plate 24A for a first width between the guide tracks 30 and 32. To adjust the width so as to increase the distance between the guide tracks 30 and 32, the indentations 100 are disengaged from the protuberances in the channel 98 so that the guide track 32 is movable to the position shown in dashed lines in FIG. 7 where the width between the guide tracks 30 and 32 is increased. This is accomplished by the telescopic movement of the cross plates 24B and 26B outside of the respective cross plates 24A and 26A. When the cross plates 24B and 26B have been moved to the desired position corresponding to the width between the guide tracks 30 and 32, the protuberances 98 within the respective channels 24A and 26A engage the recesses 100 on the respective cross plates 24B and 26B.

Once the cross plates have been adjusted to the desired position to fit within a cabinet, the cross plates are secured to the base of the cabinet by the fasteners 28, as above described. The fasteners are easily engaged and disengaged from the base of the cabinet.

The storage trays 12-18 that form the shelf apparatus 10 may be fabricated of any desired material using conventional manufacturing processes. The trays 12-18 may be fabricated of sheet metal and the walls connected by fasteners, welding, or any suitable means. The trays may also be fabricated of plastic or any desired polymeric material utilizing known forming processes, such as injection molding and extrusion. Using these methods, allows trays or shelves to be fabricated in desired widths as determined by the cabinet size in which the trays are positioned.

Figure 8:
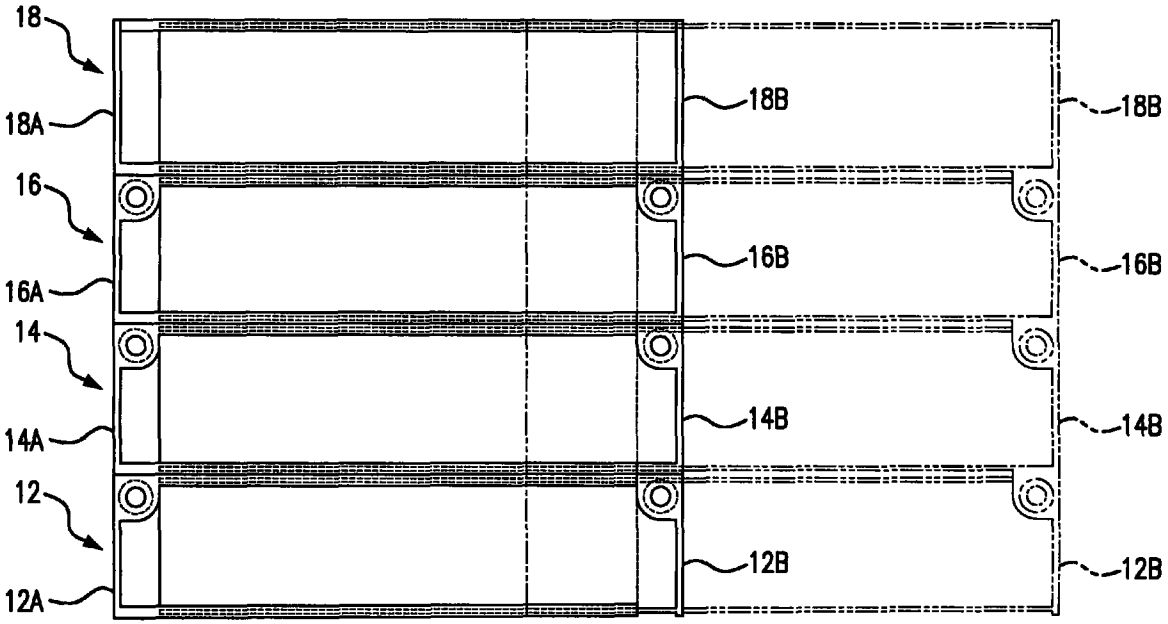
FIG. 8 is a top plan view of a telescoping embodiment of the assembly of trays, illustrating slidable components to allow for an adjustment in the width of the trays based on the width of the cabinet for receiving the shelf apparatus.
Figure 11A:
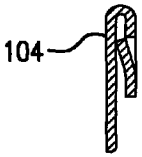
FIG. 11A is an enlarged fragmentary sectional view in side elevation of a connector for the tray components.
Figure 11:
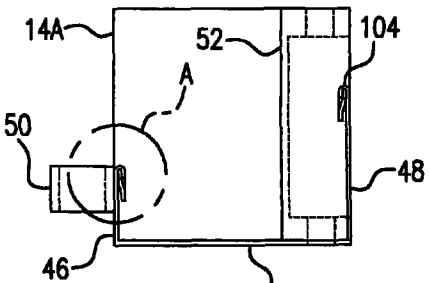
FIG. 11 is an end view of the tray component shown in FIG. 10.
Figure 9:
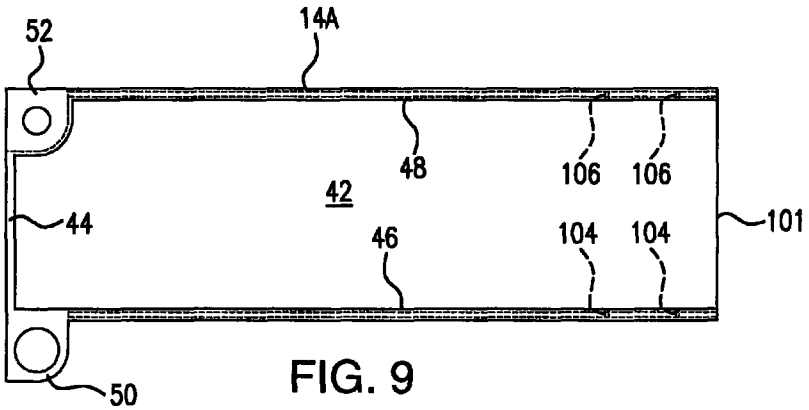
FIG. 9 is a top plan view of one component of the telescoping tray.
Figure 10:
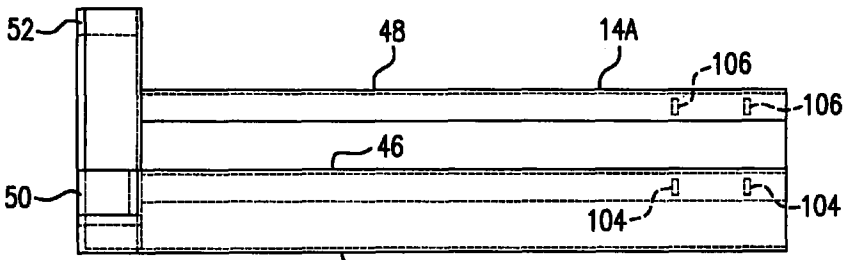
FIG. 10 is a view in side elevation of the tray component shown in FIG. 9.
Figure 12:
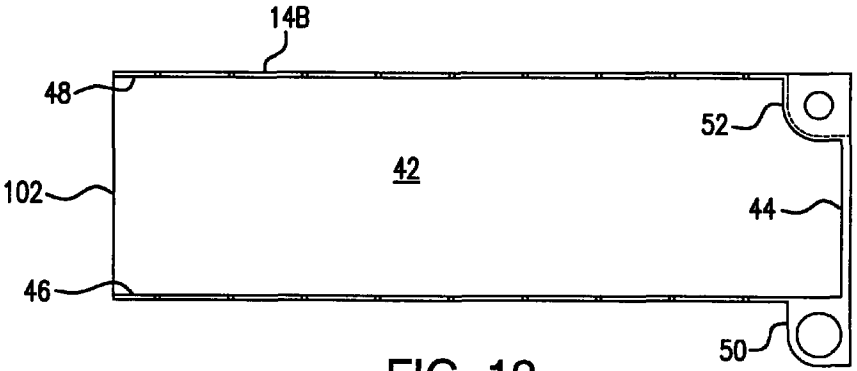
FIG. 12 is a top plan view of the telescoping tray component adopted to be slidably received within the tray component shown in FIG. 9.
Figure 13:
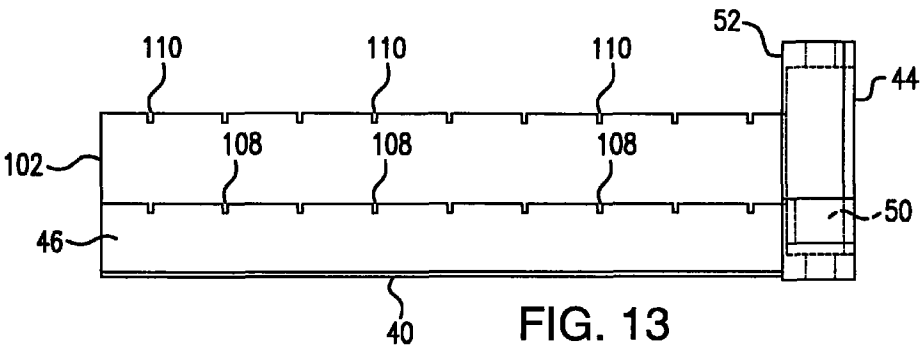
FIG. 13 is a view in side elevation of the tray component shown in FIG. 12.
Figure 14:
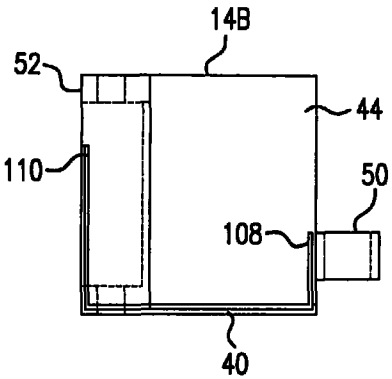
FIG. 14 is an end view of the tray component shown in FIG. 13.

With the embodiment of the present invention shown in FIG. 7 for the frame 22, the trays are formed in components that are telescopically connected so as to permit adjustments in the length of the trays corresponding to the desired width of the frame 22 between the guide tracks 30 and 32. This construction is shown in FIGS. 8-14. Like numerals identifying the elements of the storage trays or shelves 12-18 shown in FIGS. 1, 2, and 3, refer to like elements shown in FIGS. 8-14. As illustrated in FIG. 8, each of the trays 12-18 is schematically illustrated in the position that they are retained in the stored position within the cabinet 20. Each of the trays includes telescopic components to adjust the length of the trays. Specifically, tray 12 includes telescopic components 12A and 12B. Tray 14 includes telescopic components 14A and 14B. Tray 16 includes telescopic components 16A and 16B. Tray 18 includes telescopic components 18A and 18B. With the trays 12-18 described above, each of the trays includes opposite sidewalls 44; however, with the embodiment of the trays shown in FIGS. 8-14, one of the sidewalls 44 is removed. For example, components 12A and 12B shown in FIGS. 9-14 include an open end portion 100 where normally the sidewall 44 would appear for the trays shown in FIG. 1. It should be understood that the construction of the tray components 12A and 12B shown in FIGS. 9-14 correspond to the configuration of each of the components for the trays 14A, 14B; 16A, 16B; and 18A, 18B. The construction for tray components 12A and 12B are only described.

With the tray components 12A and 12B having open end portions 101, the tray component 12A slidably receives the tray component 12B. To facilitate the sliding movement, the width of the tray 12A is greater than the width of the tray component 12B so as to allow relative sliding movement of tray component 12B within tray component 12A. As seen in FIGS. 9-11A, tray component 12A is provided with protuberances 104 positioned in spaced relation adjacent to the open end portion 101 on wall 36 and protuberances 106 positioned in spaced relation on the back wall 48 adjacent the open end portion 101. An example of the protuberances 104 is shown in an enlarged view in FIG. 11A. The protuberances 104 and 106 are suitably secured as by welding or adhesive connection, to the respective walls 46 and 48.

To telescopically connect the tray component 14B within the tray component 14A, the tray component 14B is provided with notches or recesses 108 on front wall 46 and notches 110 on back wall 48. To assembly the tray components 14A and 14B, tray component 14B is inserted into the open end portion 101 of tray 14A at the open end portion 102 of tray 14B. Tray component 14B slides into the tray component 14A where the bottom wall 42 of tray component 14B is slidable on the bottom wall 42 of the tray component 14A. The tray component 14B is moved into the tray component 14A until the desired width of the assembled tray 14 is obtained. In this position, the protuberances 104 and 106 on the tray component 14A engage the notches or recesses 108 and 110 of the tray component 14B. When the protuberances engage the notches, the two tray components 14A and 14B are secured together for a fixed width.

As shown in FIG. 8, the components for the trays 12-18 are shown secured together for a first shortened width as shown in solid lines in FIG. 8. The tray components are movable so that the width can be expanded to an extended width of the trays as shown in dashed lines in FIG. 8. The width of the tray components can be adjusted between the two widths of the assembled trays as shown in FIG. 8. The desired width of the assembled trays corresponds to the desired width of the frame between the guide tracks 30 and 32. Thus, with this arrangement, the shelf apparatus 10 can be adjusted in size to accommodate a specific width of storage cabinet 20. The adjustment is easily accomplished by securing the guide tracks 30 and 32 at the desired width where the cross plates 24A, 24B and 26A, and 26B are adjusted to the desired width. The length of the storage trays is then selected to correspond to the width between the guide tracks 30 and 32 so that the guide wheels 94 and 96 on the back tray 18 roll within the channels 34 of the guide tracks 30 and 32.

The embodiment of the present invention that includes the storage trays 12-18 adjustable in length and the frame 22 adjustable in width is an alternative to the construction of storage trays 12-18 and frame 22 of a preselected width to accommodate storage cabinets of different widths. Thus, in accordance with the present invention, the shelf apparatus 10 includes a frame of adjustable width and storage trays of adjustable length. The shelf apparatus 10 is also provided with a frame 22 of a preselected width and storage trays of a preselected length fabricated of preselected materials.

According to the provisions of the patent statutes, I have explained the principle, preferred construction, and mode of operation of my invention and have illustrated and described what I now consider to represent its best embodiments. However, it should be understood that within the scope of the appended claims, the invention may be practiced otherwise then as specifically illustrated and described.

I claim:

1. Storage and display shelf apparatus for positioning on a support structure comprising:

a pair of guide tracks supported in spaced parallel relation for mounting on the support structure, said guide tracks having a front end portion and a rearward end portion, a plurality of guide wheels supported by said guide tracks, an assembly of shelves positioned one behind the other extending from a front shelf to a back shelf between said guide tracks, each of said shelves having a receptacle for receiving an item to be stored and displayed, a set of guide wheels carried on each of said shelves for engagement with said guide tracks for movement of said shelves between said guide tracks front and rearward end portions from a stored position on said guide tracks to a display position relative to said guide tracks, each of said shelves having a boss extending from opposite sides thereof in alignment with a boss extending from opposite ends of an adjacent shelf, a hinge pin extending through said aligned bosses to connect adjacent shelves, a spring surrounding said hinge pin and positioned between said aligned bosses to exert an upward biasing force upon said shelves when positioned on said guide tracks, a trunnion extending outwardly from an upper end of said hinge pin above said aligned bosses, a link arm positioned on each side of said assembly of shelves extending parallel to said guide tracks, said link arm having a front end and a rearward end with a series of spaced apart slots extending between said front end and said rearward end, said link arm rearward end being pivotally connected to said rearward shelf, said trunnion of said hinge pin positioned in said respective slot of said link arm to connect said link arm to said shelves, and said link arm being pivotal on said rearward shelf upon movement of said assembly of shelves from the stored position on said guide tracks to the display position where said shelves move off of said guide tracks and said trunnions move forward in said link arm slots so that each shelf forward of said back shelf drops down to a vertically displaced position, compressing the springs where each self is maintained at a different height on said link arms in a tiered arrangement of said shelves.

2. Storage and display shelf apparatus as set forth in claim 1 which includes, stop means positioned at said front end portion and said rearward end portion of said guide tracks for limiting forward and rearward movement of said assembly of shelves on said guide tracks.

3. Storage and display shelf apparatus as set forth in claim 2 in which, said stop means includes channel stops closing an open end of said front end portion of said guide tracks and closing an open end of said rearward end portion of said guide tracks.

4. Storage and display shelf apparatus as set forth in claim 3 in which, said set of guide wheels includes a pair of guide wheels rotatably mounted on opposite sidewalls of said back shelf, said guide wheels contact said channel stops at said front end portion of said guide tracks to prevent forward movement of said shelves when in the display position, and said guide wheels contact said channel stops at said rearward end portion of said guide tracks to prevent rearward movement of said shelves when in the stored position.

5. Storage and display shelf apparatus as set forth in claim 1 which includes, support means elevated above said guide tracks for supporting said link arm for movement with shelves between the stored position and the display position.

6. Storage and display shelf apparatus as set forth in claim 5 in which, said support means includes a guide wheel rotatably mounted on a frame extending from said guide tracks, and said link arm positioned on said guide wheel to support said link arm for movement in a horizontal position to a downwardly pivoted position upon movement of said shelves from the stored position to the display position.

7. Storage and display shelf apparatus as set forth in claim 1 in which, said slots in said link arm increase in length from said link arm rearward end to said link arm forward end so that said slots have different lengths, and said hinge pin trunnions of said shelves positioned in said slots for forward movement on said link arm where the length of travel of said trunnions in said slots is determined by the length of said slots so that when said link arm pivots downwardly each shelf has a different length of travel on said link arm to allow said shelves to drop vertically displaced from one another to progressively elevated positions in the display position.

8. Storage and display shelf apparatus as set forth in claim 1 in which, said assembly of shelves each includes a bottom wall, oppositely positioned spaced apart sidewalls connected to said bottom wall, a front wall connected to said sidewalls and extending upwardly from said bottom wall, and a back wall connected to said sidewalls spaced from said front wall and extending upwardly from said bottom wall to form a receptacle for receiving items to be stored and displayed on said shelves.

9. Storage and display shelf apparatus as set forth in claim 1 which includes, a linear bearing positioned in a selected one of said bosses extending from each of said shelves for supporting said hinge pin in said selected boss.

* * * * *